US010835016B1

(12) United States Patent
Galitello

(10) Patent No.: US 10,835,016 B1
(45) Date of Patent: Nov. 17, 2020

(54) COSMETIC CASE

(71) Applicant: Jane Galitello, Port Richey, FL (US)

(72) Inventor: Jane Galitello, Port Richey, FL (US)

( * ) Notice: Subject to any disclaimer, the term of this patent is extended or adjusted under 35 U.S.C. 154(b) by 0 days.

(21) Appl. No.: 16/514,355

(22) Filed: Jul. 17, 2019

(51) Int. Cl.
*A45D 40/02* (2006.01)
*A45D 40/22* (2006.01)

(52) U.S. Cl.
CPC ..... *A45D 40/026* (2013.01); *A45D 40/222* (2013.01); *A45D 40/023* (2013.01)

(58) Field of Classification Search
CPC .. A45D 40/026; A45D 40/222; A45D 40/221; A45D 40/02; A45D 40/023
See application file for complete search history.

(56) References Cited

U.S. PATENT DOCUMENTS 1,919,133 A * 7/1933 Rolot ..... A45D 40/023 401/59
1,977,733 A * 10/1934 Mitchell ..... A45D 40/023 401/82
2,019,681 A * 11/1935 Kasdan ..... A45D 40/023 401/59
4,182,945 A * 1/1980 McArdle ..... A45D 40/02 132/318
6,315,479 B1 11/2001 Sakurai
6,409,403 B1 * 6/2002 Woos ..... A45D 40/023 220/836
10,231,529 B2 * 3/2019 Anderson ..... A61M 35/003

* cited by examiner

*Primary Examiner* — David J Walczak
(74) *Attorney, Agent, or Firm* — Sanchelima & Associates, P.A.; Christian Sanchelima; Jesus Sanchelima

(57) ABSTRACT

A cosmetic case is covered with a hinge and attachable cap to save a user effort in operation. The cosmetic case is covered by a simple design and construction of the hinge and attachable cap with a bore, which could be attached to a protrusion on the cosmetic case during usage. The cap could also be actuated by the slider assembly and move along a path enabling attachment to the bottom portion of the cosmetic case. The cosmetic case covered with an attachable and sliding cap, houses a cosmetic and slider assembly, which could be used in ease by any professional beauticians, or anyone of interest at home. The cosmetic case configured with the attachable cap, avoids inconveniences caused to the user during cosmetic application.

10 Claims, 3 Drawing Sheets

COSMETIC CASE

BACKGROUND OF THE INVENTION

1. Field of the Invention

The present disclosure relates to a cosmetic case. More particularly, the present disclosure relates to a stick-type cosmetic case such as, lipstick case, with a cap, which could be attached to the cosmetic case during usage.

2. Description of the Related Art

Generally, an existing stick-type cosmetic case or lipstick case comprises a bottom tube with an opening on its top, covered by a lid/cap. The cap is hinged to a top end surface of the tube. The bottom tube would be a symmetrical body, where it could be divided into two equal casing halves. The bottom tube is manufactured by combining two equal casing halves, via any known fastening means. Further, the bottom tube houses a cosmetic with a slider assembly that enables to be protruded from and received into the case, via an opening of the bottom tube, in response to a sliding operation of a slider. The slider is positioned between the two equal casing halves of the bottom tube. Existing cosmetic construction makes the stick-type cosmetic ready for application by a single sliding operation of the slider.

During usage, a user has to open the cap and actuate the slider that enables the cosmetic to protrude out of the bottom tube. While applying the cosmetic, the hinged cap would be freely movable without any control from the bottom tube of the cosmetic case, as the bottom tube alone would be held by the user. Henceforth, the freely movable cap causes inconvenience to the user during cosmetic application. Further, user must adjust the position of the cosmetic case and apply the cosmetic in specific direction, to avoid the disturbance or hindrance occurred due to its freely movable cap.

Several devices have been designed in the past. None of them, however, include a cosmetic case that is capable of addressing the foregoing discussed issues.

Applicant believes that a related reference corresponds to U.S. Pat. No. 6,315,479 filed by Tornio Sakurai describes a case for accommodating a stick-type cosmetic preparation. The case comprises a main body defining an opening into a bore portion thereof. A sleeve is provided which is formed to receive at least a protruding end portion of the stick-type cosmetic preparation therein. A support member cooperates with the sleeve to support a lower portion of the stick-type cosmetic preparation. The case further includes a cover member pivotally attached to the main body through a hinge to freely open and close the main body about a hinge axis. An operation member is slidably disposed on the main body along a path on of the main body. The case includes a lifting mechanism which cooperates with the sleeve and the operation member to contact a protruding end of the sleeve against the cover member. This contact enables opening of the cover before the protruding end portion of the stick-type cosmetic preparation is protruded from the sleeve and the bore portion of the main body in response to a sliding motion of the operation member along the path. However, Sakurai reference lacks to address the inconvenience caused by the freely movable hinged cap to the user during cosmetic application.

Another related reference is U.S. Pat. No. 3,810,700 filed by J Bryan describes a slide closure cosmetic stick dispenser casing. The cosmetic stick dispenser casing comprises a two-piece, tubular plastic body having left and right halves divided along a median, longitudinal plane, and a one-piece plastic cup and manually-operable push-pull strap, the latter riding in a groove having a direction-reversing bend whereby the operable portion of the strap and the cup move in opposite directions. The casing halves have keying projection-and-socket means at the direction-reversing portion of the groove whereby assembly of the parts can be easily effected by laying the cup and strap in that casing half which has the projection, with the strap curved and additionally confined by the projection, and thereafter applying the other casing half having the socket, over the assemblage that includes the cup and strap. However, Bryan reference also lacks to address the inconvenience caused by the freely movable hinged cap to the user during cosmetic application.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a cosmetic case, for example, lipstick case, covered with a hinge and attachable cap, for saving a user effort during usage.

It is another object of the present invention to provide a cosmetic case covered by a hinge and attachable cap, housing a cosmetic and slider assembly that could be used in ease by any professional beauticians, or anyone of interest at home.

It is another object of the present invention to provide a cosmetic case covered by a simple design and construction of the hinge and attachable cap with a bore, which could be attached to a protrusion on the cosmetic case.

It is yet another object of the present invention to provide a cosmetic case covered by a simple design and construction of the hinge and attachable cap, which could be actuated by the slider assembly and move along a path enabling attachment to the bottom portion of the cosmetic case.

It is yet another object of the present invention to provide a cosmetic case configured with the attachable cap, avoids inconveniences or disturbances that were caused in existing cosmetic cases design to the user during cosmetic application.

It is yet another object of the present invention to provide a cosmetic case configured with the attachable cap of different shape, but not limited to, cylindrical or conical shape.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

Figure 1:
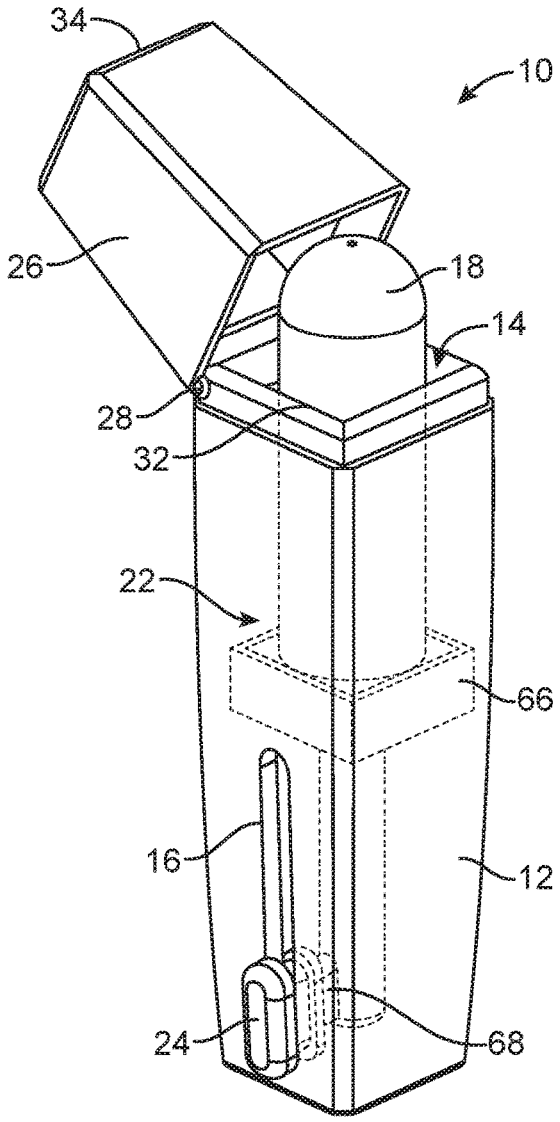
FIG. 1 exemplarily illustrates a perspective view of a cosmetic case 10 with open position of an attachable cap 26 from its lower body 12, according to an embodiment of the present invention.
Figure 2:
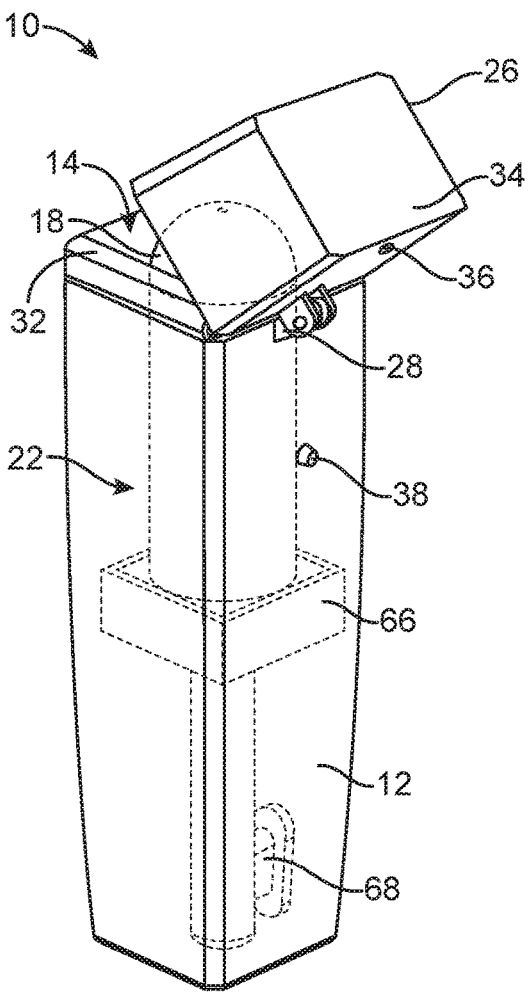
FIG. 2 exemplarily illustrates a perspective view of a cosmetic case 10 with open position of the attachable cap 26 comprising a bore 36 and a protrusion member 38 in the lower body 12, according to an embodiment of the present invention.
Figure 3:
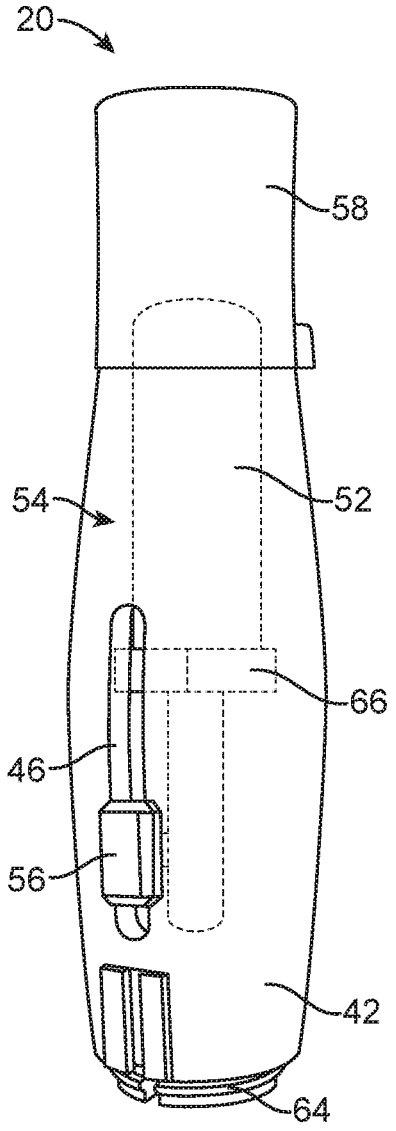
Figure 4:
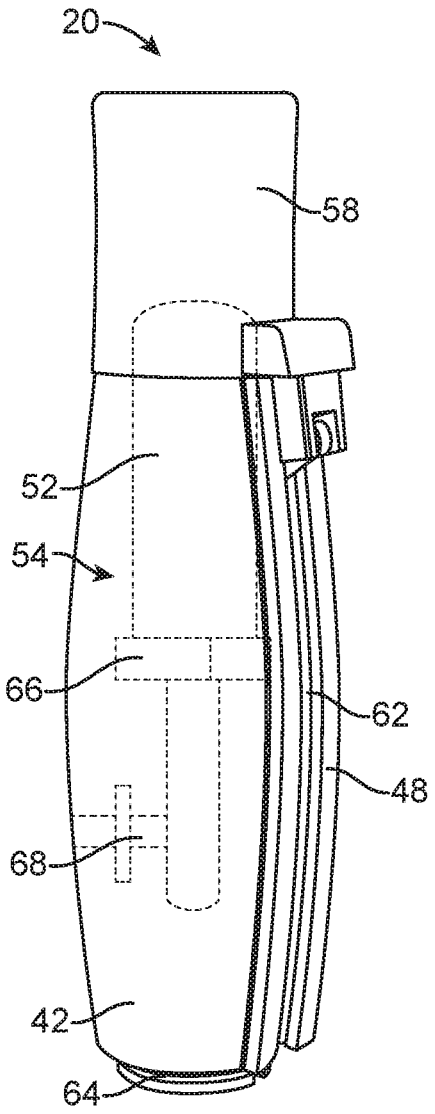
Figure 5:
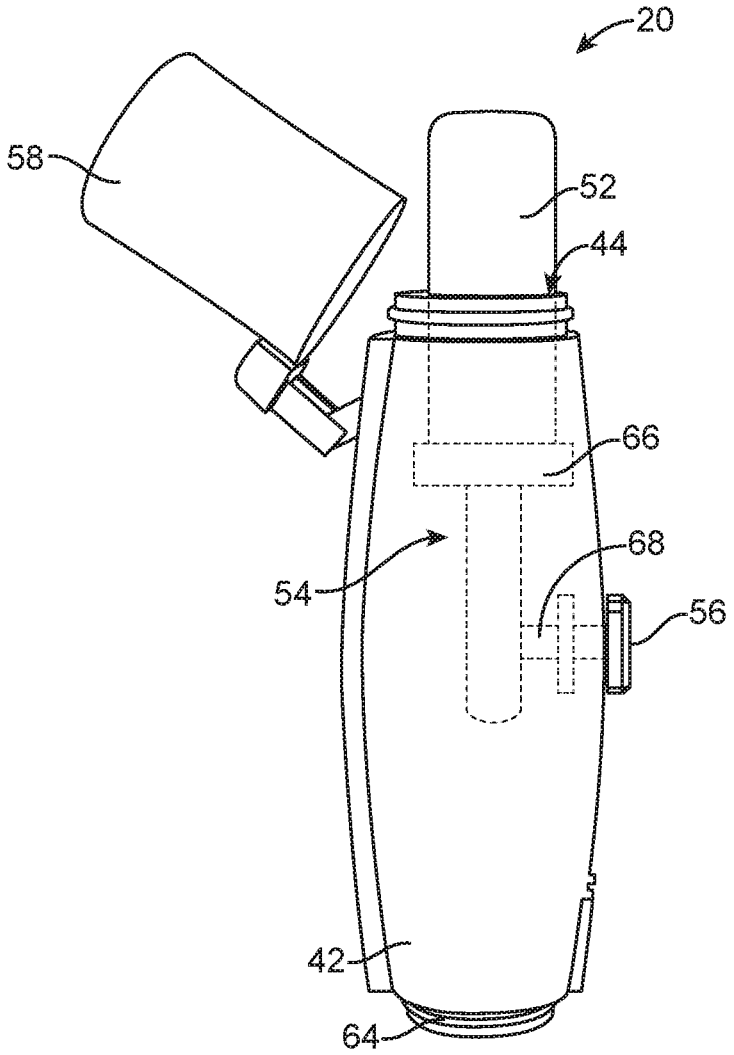

FIG. 3 exemplarily illustrates a perspective view of a cosmetic case 20 with closed position of an attachable and sliding cap 58, according to another embodiment of the present invention;

FIG. 4 exemplarily illustrates a perspective view of a cosmetic case 20 with closed position of an attachable and sliding cap 58 that can move along a sliding path 62 on the lower body 42, according to an embodiment of the present invention; and FIG. 5 exemplarily illustrates a side view of a cosmetic case 20 with open position of an attachable and sliding cap 58 that can move along a sliding path 62 on the lower body 42, according to an embodiment of the present invention.

DETAILED DESCRIPTION OF THE EMBODIMENTS OF THE INVENTION

Referring now to the drawings, FIGS. 1-5, where the present invention is generally referred with numeral 10, it can be observed that cosmetic case 10 that provides convenience to the user during cosmetic application is disclosed.

In an embodiment, the cosmetic case 10 comprises, a two-piece lower body 12, which is attached to define a top opening 14 and a side opening 16. Lower body 12 is configured to accommodate a cosmetic 18 incorporated with a slider assembly 22. In one embodiment, cosmetic case 10 further comprises a slider 24, which is connected to the slider assembly 22, and slidably disposed on side opening 16 of lower body 12. Slider 24 in response to a sliding operation by a user enables the cosmetic 18 to protrude from and received into lower body 12, via top opening 14.

In one embodiment, a cap 26 is hinged to an end 28 of a top portion 32 of lower body 12. A side surface which is adjacent to an upper surface 34 of cap 26 comprises a bore 36. Lower body 12 comprises a protrusion member 38 proximally positioned beneath hinged end 28 of cap 26. Bore 36 in the side surface being adjacent to the upper surface 34 of cap 26, is configured to receive and detachably attach protrusion member 38 of lower body 12, during the protrusion of cosmetic 18 from top opening 14 of lower body 12 in the cosmetic case.

In another embodiment of the present invention, a cosmetic case 20 such as, lipstick case, with a sliding and attachable cap 58, which could be attached to cosmetic case 20 during usage, is disclosed. Cosmetic case 20 comprises a two-piece lower body 42, which attached to define a top opening 44 and at least two side openings, first side opening 46 and second side opening 48. Two-piece lower body 42 is configured to accommodate a cosmetic 52 incorporated with a slider assembly 54.

In one embodiment, cosmetic case 20 further comprises a slider 56, which is connected with slider assembly 54, and slidably disposed on first side opening 46 of lower body 42. Slider 56 in response to a sliding operation by a user enables cosmetic 52 to protrude from and received into lower body 42, via top opening 44. In one embodiment, cap 58 is connected with slider assembly 54, slidably disposed on second side opening 48 of lower body 42. Cap 58 in response to a sliding operation of the slider 56 by a user enables cap 58 to move along a sliding path 62 and detachably attach a bottom portion 64 of lower body 42 in the cosmetic case 20. In some embodiments, protrusion member 38 is dimensioned to receive and lock into bore 36 of cap 26.

According to an embodiment of cosmetic case 20, first side opening 46 is opposingly positioned to second side opening 48 in lower body 42. Further, bottom portion 64 of lower body 42 may be of groove shape, configured to receive and detachably attach cap 58.

In one embodiment, the two-piece lower body either lower body 12 or lower body 42 of the the cosmetic case, either cosmetic case 10 or cosmetic case 20 is symmetrically attached via an adhesive or a binder. Slider assembly 22 or slider assembly 54 comprises a cosmetic tray 66 to hold the cosmetic 18 or cosmetic 52 within the lower body 12 or lower body 42. In one embodiment, cosmetic tray 66 is attached to slider 24 or 56, via a connector 68. Connector 68 is a support plastic cylinder, that can also be included as core, to lift up and down the cosmetic tray 66.

In one embodiment, cosmetic 18 or cosmetic 52 may be of any shape, but not limited to, cylinder or square shape. The cosmetic case 10 or cosmetic case 20 and its components are made of any material, but not limited to, plastic material. In yet another embodiment, the cosmetic case 10 or cosmetic case 20 and its components are made of at least one of polycarbonate, polyethylene, polyethylene terephthalate, polypropylene, polystyrene, polyvinyl chloride, and any mixtures thereof. In some embodiments, the cosmetic case 10 or cosmetic case 20 is made of a recyclable or eco-friendly material. In one embodiment, cap 26 or cap 58 is configured to completely seal the top portion 32 of the lower body 12 or lower body 42, and rotatable around the lower body 12 or lower body 42 which is, but not limited to, 2 mm diameter. In one embodiment, bore 36 in the side surface adjacent to the upper surface 34 of cap 26 is engraved of, but not limited to, 5 mm height and 1 mm thickness, to receive and attach the protrusion member 38 of the lower body 12.

Advantageously, the cosmetic case (10, 20), for example, lipstick case, is covered with a hinge and attachable cap (26, 58), for saving user efforts during usage. The cosmetic case (10, 20) covered with a hinge and attachable cap (26, 58) housing a cosmetic (18, 52) and slider assembly (22, 54), could be used in ease by any professional beauticians, or anyone of interest at home. The cosmetic case (10, 20) according to the present invention, is simple in design and construction. The cosmetic case (10, 20) configured with the attachable cap (26, 58), avoids inconveniences or disturbances that were caused in existing cosmetic cases design to the user during cosmetic application.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A cosmetic case, comprising:

a lower body attached to define a top opening and a side opening thereof, said lower body including a slider assembly, said lower body housing a cosmetic;

a slider connected with the slider assembly, slidably disposed on the side opening of the lower body, said slider in response to a sliding operation by a user enables the cosmetic to protrude from and be received into the lower body, via said top opening, wherein said slider assembly includes a cosmetic tray located within said lower body, wherein said cosmetic tray is a flat platform which receives said cosmetic on a top end, said slider assembly further including a connector having a vertical portion and a horizontal portion, wherein said vertical portion is mounted entirely beneath said cosmetic tray and extends downwardly therefrom, wherein said horizontal portion extends horizontally from said vertical portion and is communicably attached to said slider, wherein said vertical portion moves said cosmetic tray holding said cosmetic upwardly when said slider is upwardly engaged; and a cap hingedly attached to an end of a top portion of the lower body, wherein a side surface that is adjacent to an upper surface of the cap comprises a bore, and the lower body comprises a protrusion member proximally positioned beneath the hinged end of the cap, wherein the bore in the side surface adjacent to the upper surface of the cap is configured to detachably attach to the protrusion member of the lower body, during the protrusion of the cosmetic from the top opening of the lower body in the cosmetic case.

2. The cosmetic case of claim 1, wherein the cosmetic is of cylinder or square shape.

3. The cosmetic case of claim 1, wherein said lower body and said cap are made of a plastic material.

4. The cosmetic case of claim 1, wherein the protrusion member is dimensioned to receive and lock into the bore of the cap.

5. The cosmetic case of claim 1 wherein said side opening is a vertical slit located partially along a side of said lower body.

6. The cosmetic case of claim 1 wherein said horizontal portion extends toward said side opening.

7. The cosmetic case of claim 1 wherein said cosmetic tray has a rectangular shape.

8. The cosmetic case of claim 1 wherein said cosmetic protrudes outwardly from said top opening when said slider is engaged in a lowest position.

9. The cosmetic case of claim 1 wherein said lower body includes a rectangular frame surrounding said top opening.

10. A cosmetic case, consisting of:

a) a lower body having a rectangular shape with four sidewalls defining a top opening, wherein said lower body further includes a side opening, wherein said side opening is a vertical slit extending vertically along one of said four sidewalls of said lower body, said lower body housing a cosmetic therein;

b) a cap with a top surface hingedly mounted to a top edge of said lower body, wherein said cap includes a side surface being adjacent to said top surface including a bore, said lower body including a protrusion member protruding from one of said four sidewalls positioned beneath a hinged end of said cap, wherein said bore receives said protrusion member to be removably attached thereon; and c) a slider assembly including a cosmetic tray located within said lower body, wherein said cosmetic tray is a flat platform which receives said cosmetic on a top end, said cosmetic extending upwardly from said cosmetic tray, a connector including a vertical portion and a horizontal portion, wherein said vertical portion is mounted entirely beneath said cosmetic tray, wherein said vertical portion extends downwardly from a bottom end of said cosmetic tray, said horizontal portion horizontally extending from said vertical portion toward said side opening of said lower body, a slider mounted to said side opening communicably attached to said horizontal portion, wherein said vertical portion moves said cosmetic tray upwardly when said slider is engaged in an upward motion along said side opening.

* * * * *